United States Patent [19]

Fitzgerald et al.

[11] Patent Number: 4,867,208

[45] Date of Patent: Sep. 19, 1989

[54] APPARATUS FOR STORING AND DISPENSING FLUID UNDER PRESSURE

[76] Inventors: Robert M. Fitzgerald, 3545 Saxon Way, Marietta, Ga. 30062; Eugene O. Gresens, 5266 Westhill Dr., Norcross, Ga. 30071

[21] Appl. No.: 152,399

[22] Filed: Feb. 4, 1988

[51] Int. Cl.[4] ..... B65B 3/04

[52] U.S. Cl. ..... 141/18; 141/26; 141/94; 141/114; 222/94; 222/386.5; 446/475

[58] Field of Search ..... 141/2, 18, 25, 26, 27, 141/94, 95, 98, 114; 446/475; 222/94, 95, 96, 105, 183, 396, 397, 386.5, 41, 44, 45, 212, 213

[56] References Cited

U.S. PATENT DOCUMENTS

| | | | |
|---|---|---|---|
| 2,638,250 | 5/1953 | Houldsworth | 222/95 |
| 2,755,967 | 7/1956 | Anderson et al. | 222/96 |
| 3,486,539 | 12/1969 | Jacuzzi | 222/386.5 X |
| 3,976,223 | 8/1976 | Jass et al. | 222/94 |
| 4,077,543 | 3/1978 | Kulikowski et al. | 222/95 |
| 4,121,737 | 10/1978 | Kain | 222/95 |
| 4,135,559 | 1/1979 | Barnby | 141/18 |
| 4,257,460 | 3/1981 | Puranay et al. | 141/26 |
| 4,735,239 | 4/1988 | Salmon et al. | 141/25 |

*Primary Examiner*—Ernest G. Cusick
*Attorney, Agent, or Firm*—Needle & Rosenberg

[57] ABSTRACT

An apparatus capable of storing and expelling a large quantity of fluid is provided, having an elastic hollow tube having an open end through which fluid may be inserted into and expelled out of the tube; hollow elongate outer enclosure surrounding the tube, and a slidable inner sleeve located between the tube and the outer enclosure. The inner sleeve slides through the outer tube upon contact by the tube as the tube axially expands, thereby preventing crimping of the tube.

15 Claims, 4 Drawing Sheets

APPARATUS FOR STORING AND DISPENSING FLUID UNDER PRESSURE

BACKGROUND OF THE INVENTION

The present invention relates to an apparatus which provides for the portable storage of a large quantity of fluid under pressure, and more particularly to a container capable of having a large quantity of fluid inserted into it and also capable of expelling the fluid as a stream over considerably great distances and at significant pressure.

Containment devices capable of expelling fluid under pressure are well known, and have typically consisted of an elastic bladder housed inside a rigid housing. In operation, the bladder would be filled with the fluid and sealed. Unsealing of the bladder causes the bladder to constrict and the fluid to be expelled from the device. Such devices have typically been used in water squirt toys of the water-gun type, or as a means for propelling toy rockets and cars. Examples can be seen in U.S. Pat. Nos. 4,257,460 to Paranay et al., 4,135,559 to Barnby, and 2,101,646 to Gordon.

However, a problem exists with the current containment devices. While the rigid housing is necessary for providing stability to the device and for protecting the user against harm caused by an exploding bladder, it often limits the amount of fluid capable of being held within the device. Typically, as fluid is inserted into the bladder, the bladder first expands radially at its approximate midpoint and then expands axially. At a certain point, the radial expansion causes the bladder to contact the inner wall of the housing. Further filling causes the device to malfunction due to a restriction to axial expansion. The restriction occurs because the bladder is fixed to one end of the housing where the water is being injected or ejected, and becomes stuck on the housing inner wall due to the friction forces caused by the radial expansion. Further axial expansion causes the unexpanded bladder to fold over on itself and crimp, which then inhibits or prevents further filling or emptying. To solve this problem, current containers are designed having large housings and comparatively small bladders. While this design prevents the bladder from ever meeting the inner wall of the housing, it also greatly reduces the amount of fluid capable of being stored. A design which allows the bladder to expand freely can cause the bladder material to exceed its elastic limit. This causes the bladder to burst or significantly shortens the life of the bladder.

Therefore, there exists a need for a device capable of storing a large volume of fluid under pressure.

There also exists a need for such a device which eliminates the problems associated with a bladder expanding and contacting the inner walls of a surrounding rigid housing.

There exists a further need for such a device which expels the stored fluid for a great distance at significant pressure.

There exists a still further need for such a device which is safe to use and relatively simple in design.

SUMMARY OF THE INVENTION

The present invention provides an elongate hollow tube made of an elastic material which acts as a bladder for storing fluid inside the device. The tube is affixed at one end, to a stationary supporting structure. Fluid may be inserted into the tube at its fixed end, thereby causing the tube to expand first radially at about its longitudinal midpoint. Continued filling causes the tube to expand radially and axially. The fluid may also be later expelled from the tube at a significant pressure by constriction of the tube.

An elongate rigid housing, or outer sleeve, is provided to house the tube and to contain splashing water should the tube leak or burst. An elongate rigid inner sleeve is provided between the tube and the outer sleeve. The inner sleeve is preferably a hollow cylindrical structure having an inside diameter less than that of the tube when the tube is in expanded condition. The diameter of the inner sleeve is selected to maintain the tube material within its elastic limit when expanded. The length of the inner sleeve may vary so that contact is made between the tube and the interior wall of the inner sleeve when the tube is expanded. The inner sleeve and outer sleeve should be in a free sliding relationship so that, as the tube contacts the inner sleeve, the inner sleeve moves through the outer sleeve so as to prevent crimping.

In operation, fluid is inserted under pressure into the open end of the tube and the tube first expands radially at its approximate midpoint and then radially and axially. Eventually, the expanding tube contacts the interior wall of the inner sleeve. The tube, as it expands, causes the inner sleeve to slide down the outer sleeve in a direction away from the affixed end. As such, the point of contact between the expanded tube and the inner sleeve moves and the problem of the tube becoming stuck against the housing wall is eliminated, as is the problem of crimping. As a result, a greater length of the tube can be used than in previously known devices and more fluid can be stored. The fact that the tube material is maintained within its elastic limit results in the fluid being contained at greater pressure and expelled for a greater distance.

Although not required, elastic attachment means may be attached between the inner sleeve and the outer sleeve. Such means will act to bring the inner sleeve back to its original, forward position within the outer sleeve upon expulsion of fluid from the tube.

Fluid release means are provided, and may include a controllable valve located at the fixed end of the tube for controllable releasing fluid from the tube through a nozzle. A trigger handle may be provided for opening and closing the controllable valve, allowing the device to be used as a squirtgun.

The present invention may also have alternate means for removing fluid from the tube for acting as a quick relief in the event of over-filling. A spring-loaded relief valve is located at the unfixed end of the tube with a discharge post which extends towards a surface at the rearward end of the outer sleeve. When the discharge post makes contact with the rearward end of the outer sleeve, the relief valve is opened and fluid is expelled from the tube.

Therefore, it is an object of the present invention to provide an improved device capable of storing a large volume of fluid under pressure.

It is also an object of the present invention to provide a device which eliminates the problems associated with a bladder expanding and contacting the inner walls of a surrounding rigid housing.

It is a further object of the present invention to provide a device which expels the stored fluid at a great distance at significant pressure.

It is a still further object of the present invention to provide a device which is safe to use and relatively simple in design.

These and other objects and advantages of the present invention will appear from the following description with reference to the drawings.

DETAILED DESCRIPTION OF THE DRAWINGS

The preferred embodiment is now described with reference to the drawings, in which like numbers indicate the like parts throughout the views. Referring to the figures, the apparatus for providing portable storage of a fluid under pressure of the present invention is illustrated in a preferred embodiment detailing a water squirtgun 10.

Figure 1:
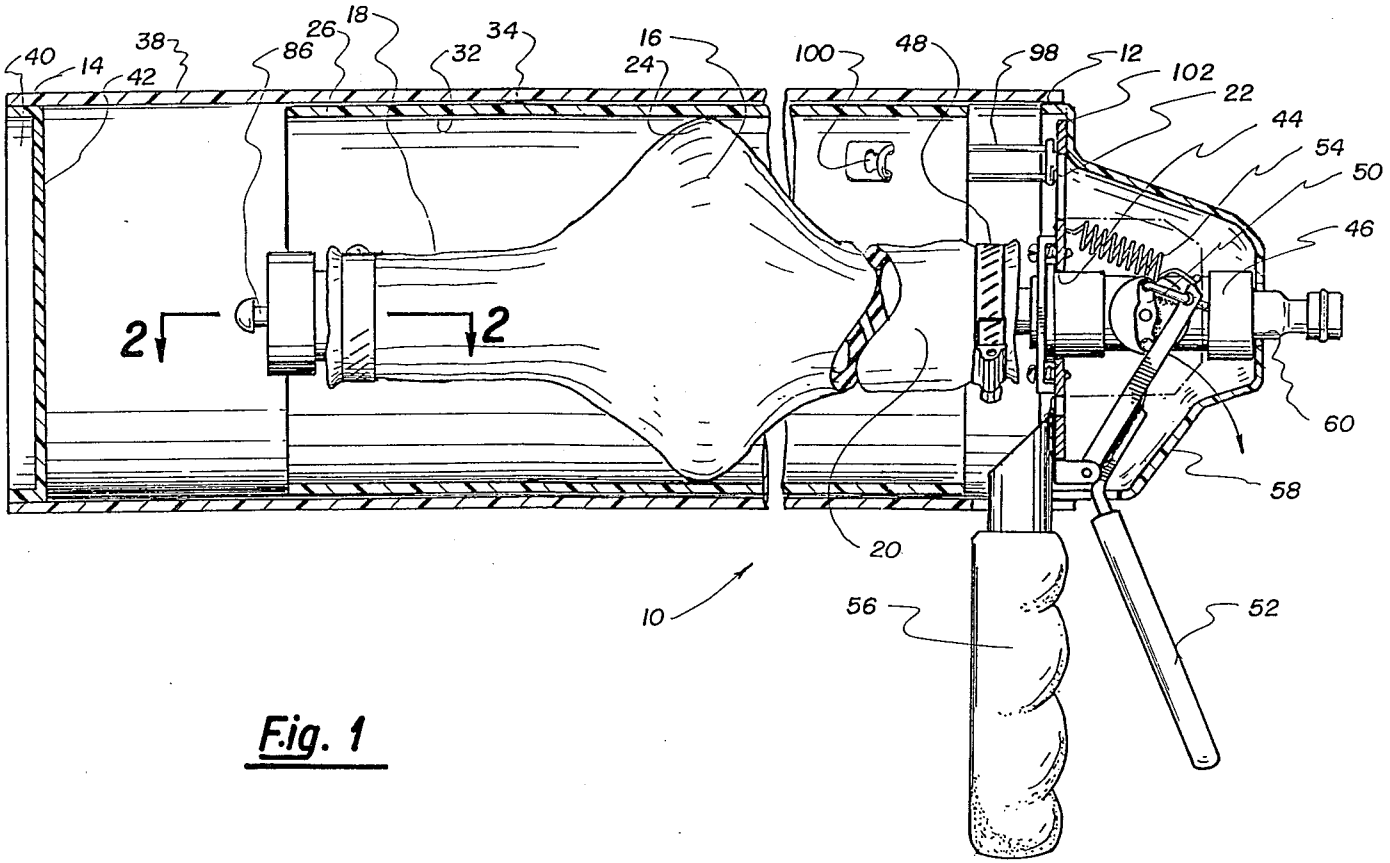
FIG. 1 is a partial cross-sectional view of the present invention embodied as a squirtgun.

As seen in FIG. 1, the gun 10 has a forward end 12 and a rearward end 14. An elongate hollow tube 16 is provided for acting as a bladder-type reservoir. The tube 16 has a rearward end 18 and an open end 20, opposite the rearward end 18, through which fluid may be inserted into the tube 16. The tube 16 is made of an elastic material, such as rubber, so that as it is filled with fluid, pressure is built up in the tube 16 and the tube 16 expands both radially and axially. The open end 20 of the tube 16 is affixed to a plate 22 which may be fixed to the outer sleeve described below or other stabilizing means. If the tube wall is equal in thickness and has no weak points along its length, the tube 16 will expand first at a point approximately at the midpoint 24 of its length and will continue to expand down the length of the tube 16 both toward the rearward end 18 and toward the open end 20.

An elongate inner sleeve 26 is made of a rigid material, preferably plastic, and is preferably tubular in shape so that the tube 16 may be positioned longitudinally within it. The inside diameter of the inner sleeve 26 is selected to maintain the elastic tube 16 within its elastic limit while allowing the tube 16 to expand axially to a desired length. The length of the inner sleeve 26 may vary so long as the most expanded point of the tube 16 contacts the inner wall 32 of the inner sleeve 26 upon radial expansion, as discussed more fully below.

An elongate outer enclosure sleeve 34, extending generally the length of the device, is provided to act as a stabilizing and enclosing housing for the device 10. The outer sleeve 34 is made of a rigid material and has a diameter slightly larger than that of the inner sleeve 26. The inner sleeve 26 is initially positioned inside the outer sleeve 34 toward the front of the device and should slide freely within the outer sleeve 34. The length of the outer sleeve 34 should be such as to allow it to enclose the inner sleeve 26 as the inner sleeve 26 slides upon complete expansion of the tube 16, as discussed more fully below. An end cap 42 is located in the opening 40 of the rearward end 38 of the outer sleeve 34.

As a water squirtgun, the device 10 has a trigger mechanism at its forward end 12 for controllably expelling liquid from the tube 16. The stabilizing plate 22 has a though opening 44 located at the forward end 12 of the outer sleeve 34. A nozzle 46 is flowingly attached to the open end 20 of the tube 16 and is held in stable position by the stabilizing plate 22. It is the fixation of the tube 16 at the forward end of the outer sleeve which causes the combination of tube 16 and inner sleeve 26 to move rearward as tube 16 is expanded during filling. A clamp 48 or other fastening means may be provided to connect the tube 16 to the nozzle 46. The nozzle 46 should be of such a type which enables fluid to be inserted into the tube 16 from an outside fluid source (not shown) and which has a control valve 50 for allowing fluid stored in the tube 16 to be controllably expelled. For example, the nozzle 46 may be coupled with an outdoor faucet by a garden hose for easy filling of the tube 16. A trigger handle 52 is attached to the control valve 50 and is used to open and close the control valve 50. A spring biasing means 54 is provided between the stabilizing plate 22 and the control valve 50 for forcing the valve 50 into a closed position when the trigger handle 52 is not depressed. A grip-bar 56 is provided adjacent the trigger handle 52 for aiding in the movement of the trigger handle 52 and for otherwise carrying the device 10. A forward end cap 58 is provided at the forward end of the device 12 and has a hole 60 through which the nozzle 46 is inserted.

Figure 2:
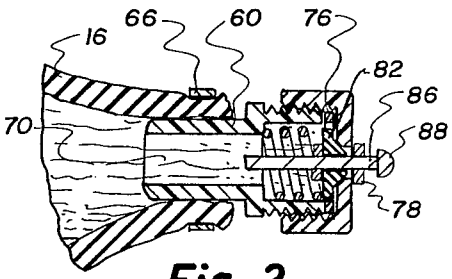
FIG. 2 is a detailed cross-sectional view of the relief means of the present invention.
Figure 4B:
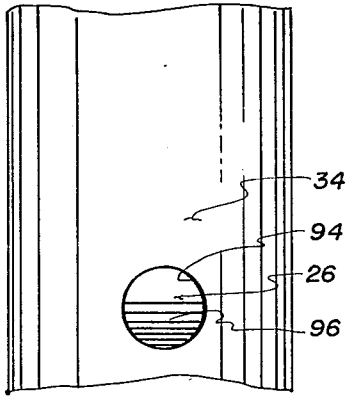
FIGS. 4*a–d* illustrate the fill-indicator of the present device.
Figure 4D:
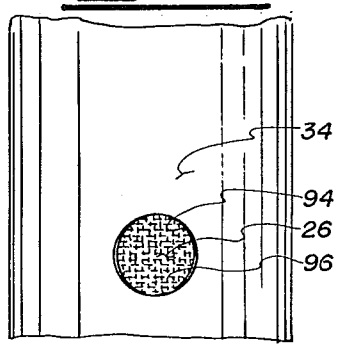
Figure 4A:
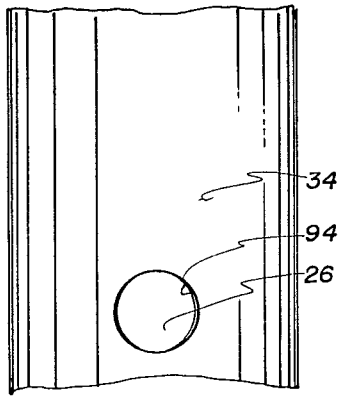
Figure 4C:
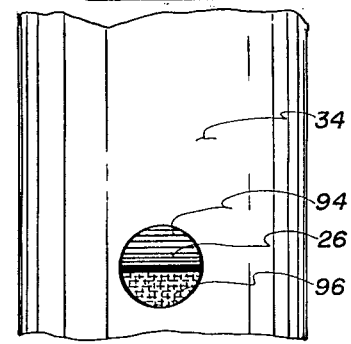
Figure 5:
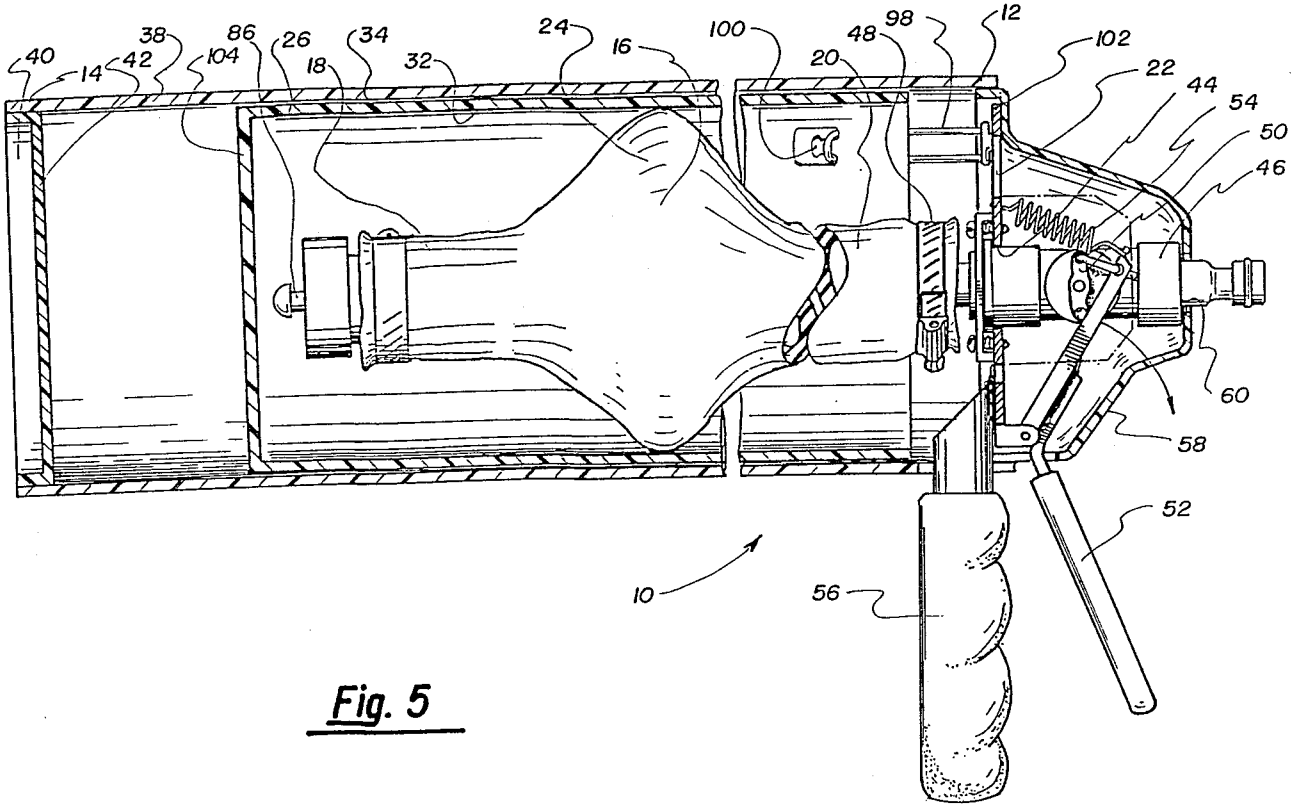
FIG. 5 is a partial cross-sectional view of an alternative embodiment of the present invention as a squirt gun.

As seen in FIG. 2, a quick-relief means is provided for causing fluid to be controllably expelled from the tube 16 in the event of overfilling. A fitting 60 is provided at the rearward end 18 of the tube 16. A clamp 66 or other fastening means may be used to fasten the fitting 60 to the tube 16. The fitting 60 has a relief passage 70 which is flowingly connected to the inside of the tube 16, as well as a radial connecting end having a cavity. A fitting cap 76 is sealingly connected to the radial connecting end of the fitting 60 and has a relief opening 78. A spring loaded plugging surface 82, preferably a disc, is held within the fitting 60 and is of a size capable of covering over and sealing the relief opening 78. The disc 82 may have spaces along its circumference for better allowing fluid to pass through it when the relief means is in operation, as discussed more fully below. A discharge post 86, optionally having post end piece 88, is is attached to the plugging disc 82 and extends outwardly through the relief opening 78 beyond the fitting cap 76 so that depression of the post 86 by contact with the rearward end cap 42 of the outer sleeve 34 during axial expansion f the tube 16 moves the plugging disc 82 through the cavity and unseals the relief opening 78. Alternatively, as seen in FIG. 5, an inner sleeve end wall 104 may be placed at the far end of the inner sleeve 26 so that the discharge post 86 becomes depressed upon contact with the inner sleeve end wall 104, thereby activating the quick-relief means. Fluid from the tube 16 is then expelled through the relief opening 78 until the depression ceases. The quick relief means also acts as means for indicating when excess fluid is being inserted into the device.

Figure 3:
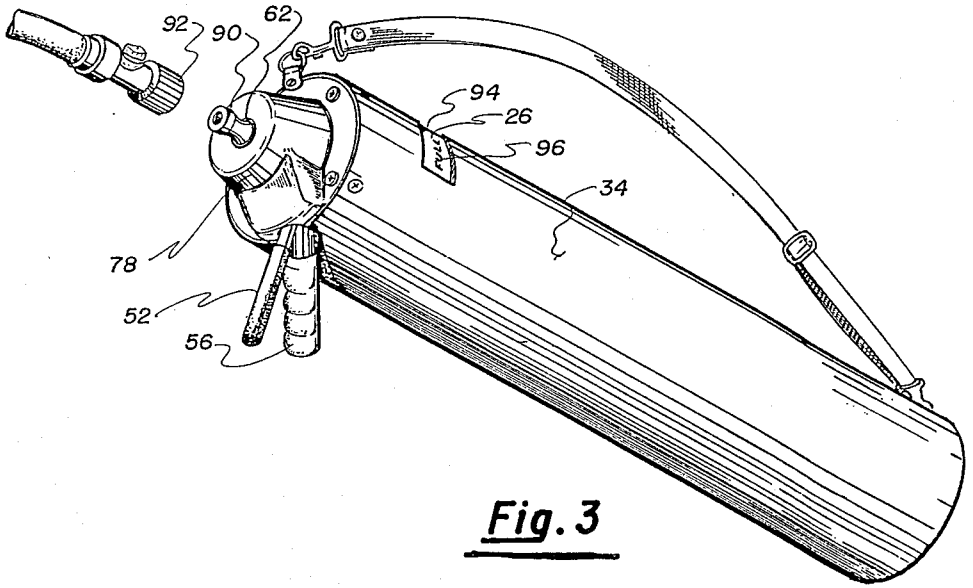
FIG. 3 is a perspective view of the present invention embodied as a squirtgun.

In the operation of the invention as a squirtgun, referring to FIGS. 1 and 3, the device 10 is filled with water by connecting the forward end 90 of the nozzle 46 to an outside source of water by a coupling device 92. The trigger handle 52 is depressed so that the control valve 50 is opened and fluid is forced into the tube 16. As the tube 16 fills, it expands radially at its approximate midpoint 24 where the radial strength at the tube 16 is typically at a minimum. Eventually, the tube 16 expands radially to a width which results in the outer wall surface of the tube 16 contacting the inner wall surface of the inner sleeve 26. As fluid continues to be inserted into the tube 16, the tube 16 continues to expand radially and axially both toward the rearward end 18 and toward the open end 20. The axial expansion toward the fixed end 20 causes the tube 16, which is contacting the inner sleeve 26 at the point of foremost radial expansion, to push the inner sleeve 26 toward the rearward end of the outer sleeve 34, and thereby prevents crimping. This allows the tube 16 to be filled with a quantity of fluid much greater than would be possible had the tube 16 contacted a stationary housing surface. Once a desired amount of fluid has been inserted into the tube 16, the trigger handle 52 can be released and the control valve 50 is closed, thereby preventing entry of any additional fluid into the device 10 and thereby providing means for maintaining the water in the tube 16 under pressure.

To prevent the need to rely on the quick-relief mechanism, a fill-indicator may be provided, as shown in FIGS. 4*a*–4*d*. A viewing portion 94 of the outer sleeve 34 may be either removed or made transparent so that the inner sleeve 26 is visible. An area of the inner sleeve exterior wall is then marked with indicia 96 at a point which is visible through the transparent portion 94 when the tube 16 contains the maximum intended quantity of fluid. The fact that the maximum amount of fluid has been inserted into the tube 16 is thus indicated to the operator. Also, the quantity of fluid contained in the tube 16 at levels between empty and full can be indicated by using gradations as the indicia 96.

To expel fluid from the device 10, the trigger handle 52 is depressed, thereby opening the control valve 50. The tube 16 then constricts as water is forced through the open end 20 of the tube 16 and out the device 10 through the nozzle 46. As the tube 16 loses fluid and contracts, the inner sleeve 26 is pulled through the outer sleeve 34 toward the forward end 12 of the device 10. When the tube 16 contracts to the point where it is no longer in contact with the inner sleeve 26, means are needed to hold the inner sleeve in a position for refilling of tube 16, preferably near the open end. An elastic means 98, such as a rubber band, may be attached at one end to the inner sleeve 26 and at another end to either the stabilizing plate 22 or the forward end 12 of the outer sleeve 34. For example, a rubber band may be attached to the inner sleeve 26 by a first tab 100 and to the stabilizing plate by a second tab 102. The elastic attachment means 98 is stretched as the inner sleeve 26 moves rearward through the outer sleeve 34, and contracts as fluid is expelled.

It should be apparent, therefore, that the present invention eliminates the problems associated with the use of a bladder-type reservoir inside a container. The movement of the inner sleeve 26 through the outer sleeve 34 allows a large volume of fluid to be inserted into the tube 16 without crimping, and the life of the tube 16 is greatly increased because the bladder is maintained within elastic limits. For example, it has been found that a natural latex rubber tube three eights of an inch thick and twelve inches long in a 4.75 inch inside diameter inner sleeve will contain a fluid at fifteen to twenty two psi pressure and release that fluid through a 0.17 inch diameter nozzle for a distance of approximately fifty feet.

It should also be noted that the present invention may have numerous embodiments other than that described herein. The particular embodiment chosen has been selected for the purpose of illustration only, and the present invention may be used in any instance in which fluid is desired to be stored under pressure.

What is claimed is:

1. An apparatus comprising:
   (a) an elastic hollow tube having an open end through which fluid may be inserted into and expelled out of said tube, said tube capable of expanding radially and axially when fluid is inserted under pressure therein;
   (b) a hollow elongated non-elastic outer enclosure surrounding said tube, said tube affixed at a first end of said outer enclosure; and
   (c) a non-elastic inner sleeve at least partially surrounding said tube and located between said outer enclosure and said tube; said inner sleeve capable of moving axially within said outer enclosure in a direction away from said first end of said outer enclosure when said tube is forced against the inner sleeve by the radial expansion of said tube.

2. The apparatus of claim 1, wherein said tube first expands at a first portion, and further comprising means for urging said inner sleeve to return and remain in position within the outer enclosure such that it surrounds the portion of said tube which first expands to contact the sleeve when fluid is inserted therein.

3. The apparatus of claim 2, wherein said means for urging said inner sleeve comprise elastic means attached to said inner sleeve at one end and to said outer enclosure at the other.

4. The apparatus of claim 1, wherein said inner sleeve is a cylindrical tube and said outer enclosure is a cylindrical tube having an inner diameter larger than the outer diameter of said inner sleeve so that said inner sleeve slides within said outer sleeve.

5. The apparatus of claim 1, further comprising alternate relief means for removing fluid from said tube to prevent over-filling of said tube.

6. The apparatus of claim 5, further comprising an outer enclosure end cap located at the end of said outer enclosure opposite said first end, and wherein said alternate relief means is a pressure-release type which is located at the expanding end of said tube and which opens upon contact with said outer enclosure end ca when said tube expands axially.

7. The apparatus of claim 6, wherein said alternate relief means is comprised of:
   (a) a fitting located along said tube having a fitting opening therethrough leading to said tube;
   (b) a fitting cap capable of sealingly connecting with said fitting and having a cap relief opening therethrough;
   (c) a plugging surface capable of fitting over and sealing said cap relief opening located between said fitting and said fitting cap to prevent passage of fluid therethrough;
   (d) a discharge post contacting said plugging surface at one end and having a contacting end extending through said cap relief opening on the opposite end; and
   (e) biasing means located between said fitting and said plugging surface for maintaining said plugging surface over said cap relief opening and for allowing movement of said plugging surface away from said cap relief opening upon application of pressure against said discharge post contacting end.

8. The apparatus of claim 5, further comprising an inner sleeve end cap located at the end of said inner sleeve adjacent said relief means, and wherein said alternate relief means is a pressure-release type which is located at the end of said tube opposite said end affixed to said outer enclosure and which opens upon contact with said inner sleeve and cap when said tube expands axially.

9. The apparatus of claim 1, further comprising means for controllably expelling said fluid from said tube.

10. The apparatus of claim 9, wherein said means for controllably expelling said fluid from said tube is comprised of:

(a) a controllable valve located at the open end of said tube and communicating with said tube so that fluid is expelled from said tube when said valve is opened; and (b) means for opening and closing said valve.

11. The apparatus of claim 10, further comprising a nozzle communicating with said controllable valve so that fluid is expelled from said apparatus through said nozzle when said controllable valve is opened.

12. The apparatus of claim 11, wherein said nozzle has means for coupling with an outside fluid source so that said tube may be filled by inserting fluid into said nozzle.

13. The apparatus of claim 11, wherein said nozzle has an expulsion opening having a diameter of approximately 0.17 inches in diameter.

14. The apparatus of claim 10, wherein said means for opening and closing said controllable valve is a lever attached to said controllable valve at one end and extending outside said outer enclosure.

15. The apparatus of claim 1 wherein said outer enclosure has a viewing portion through which said inner sleeve is visible, and wherein said inner sleeve has indicia visible through said viewing portion to indicate the quantity of fluid in said tube.

* * * * *